US008801354B2

(12) United States Patent
Lettau

(10) Patent No.: US 8,801,354 B2
(45) Date of Patent: Aug. 12, 2014

(54) WEARPAD ARRANGEMENT

(75) Inventor: Randell J. Lettau, North Bend, WA (US)

(73) Assignee: Terex South Dakota, Inc., Watertown, SD (US)

( * ) Notice: Subject to any disclaimer, the term of this patent is extended or adjusted under 35 U.S.C. 154(b) by 605 days.

(21) Appl. No.: 13/075,413

(22) Filed: Mar. 30, 2011

(65) Prior Publication Data

US 2012/0251284 A1 Oct. 4, 2012

(51) Int. Cl.
*B66C 23/70* (2006.01)

(52) U.S. Cl.
USPC ..... 414/722; 52/118; 212/350; 384/42

(58) Field of Classification Search
USPC ..... 414/718, 722; 212/348, 350; 52/118; 384/41, 42; 294/81.21
See application file for complete search history.

(56) References Cited

U.S. PATENT DOCUMENTS

| | | | | |
|---|---|---|---|---|
| 3,620,579 | A | 11/1971 | Brown et al. | |
| 3,690,742 | A | 9/1972 | Sung | |
| 3,697,141 | A * | 10/1972 | Garrett | 175/325.5 |
| 3,719,403 | A | 3/1973 | Sung | |
| 3,837,502 | A * | 9/1974 | Hornagold | 212/349 |
| 4,045,936 | A | 9/1977 | Sterner | |
| 4,133,411 | A | 1/1979 | Curb | |
| 4,171,597 | A | 10/1979 | Lester et al. | |
| 4,257,201 | A | 3/1981 | Landolt et al. | |
| 4,337,601 | A * | 7/1982 | Vaerk et al. | 52/118 |
| 4,397,426 | A | 8/1983 | Warren et al. | |
| 4,406,375 | A | 9/1983 | Hockensmith | |
| 4,657,112 | A * | 4/1987 | Ream et al. | 182/69.4 |
| 4,759,452 | A | 7/1988 | Faint et al. | |
| 4,954,041 | A | 9/1990 | Dahlquist et al. | |
| 5,129,480 | A | 7/1992 | Garrett et al. | |
| 5,174,457 | A | 12/1992 | Carroll et al. | |
| 5,718,345 | A | 2/1998 | Hade, Jr. | |

(Continued)

FOREIGN PATENT DOCUMENTS

| | | | |
|---|---|---|---|
| EP | 0 054 368 A2 | | 6/1982 |
| EP | 1 955 975 | * | 8/2008 |
| WO | 9214873 A1 | | 9/1992 |

OTHER PUBLICATIONS

International Search Report and The Written Opinion of the International Searching Authority Dated Jun. 20, 2012—9 Pages.

*Primary Examiner* — Dean Kramer
(74) *Attorney, Agent, or Firm* — Brooks Kushman P.C.

(57) ABSTRACT

A boom assembly includes a first boom member and a second boom member slidable relative to the first member in a first direction. A stop member that at least partially defines a receptacle is attached to the first member. A closure member is attachable to the first member in a fixed position and movable away from the fixed position. A planar wearpad is insertable into the receptacle in the first direction when the closure member is moved away from the fixed position and the second member is positioned on the first member. The stop and closure members inhibit lateral movement of the wearpad in a direction parallel to the plane of the wearpad, and allow movement of the wearpad in a direction transverse to the plane, when the wearpad is positioned in the receptacle. The second member inhibits movement of the wearpad in the direction transverse to the plane.

17 Claims, 4 Drawing Sheets

(56) References Cited

U.S. PATENT DOCUMENTS

| | | | |
|---|---|---|---|
| 6,109,394 | A | 8/2000 | Messenger |
| 6,499,612 | B1 | 12/2002 | Harrgington et al. |
| 6,601,719 | B2 | 8/2003 | Harrington |
| 6,726,437 | B2 | 4/2004 | Albright et al. |
| 7,293,377 | B2 | 11/2007 | Pinther, II et al. |
| 7,337,912 | B1 | 3/2008 | Hull |
| 2004/0165796 | A1 | 8/2004 | Longhurst |
| 2006/0219650 | A1 * | 10/2006 | Gokita ..... 212/350 |

* cited by examiner

WEARPAD ARRANGEMENT

TECHNICAL FIELD

The present disclosure is directed to a wearpad arrangement for use with two members, wherein one of the members is slidable with respect to the other member.

BACKGROUND

A wearpad arrangement may be used with a boom assembly having an outer boom member and an inner boom member that is slidable with respect to the outer boom member in a first direction. A prior wearpad arrangement includes eight wearpads that are attached to one rectangular end of the inner boom member, and eight wearpads that are attached to an opposite rectangular end of the outer boom member, such that two wearpads are attached to each face of the associated boom member. Furthermore, each wearpad is attached to the associated boom member with fasteners that each extend in a direction perpendicular to the first direction and into a nut inserted into the wearpad.

SUMMARY

A wearpad arrangement, according to the present disclosure, is provided for use with two members, wherein one of the members is slidable relative to the other member in a first direction. The wearpad arrangement includes a frame that is attachable to one of the members such that the frame at least partially defines a receptacle. The wearpad arrangement further includes a closure member that is attachable to the one member in a fixed position and movable away from the fixed position, and the closure member cooperates with the frame to define a retaining structure when the closure member is positioned in the fixed position. In addition, the wearpad arrangement includes a wearpad that is insertable into the receptacle in the first direction when the closure member is moved away from the fixed position and the other member is positioned on the one member. When the wearpad is positioned in the receptacle and the closure member is positioned in the fixed position, the wearpad is held loosely in the receptacle by the retaining structure, and the wearpad is inhibited from moving out of the receptacle by contact with the other member.

A boom assembly according to the present disclosure includes a first boom member and a second boom member that is slidable relative to the first boom member in a first direction. A stop member is attached to the first boom member, and the stop member at least partially defines a receptacle that faces the second boom member when the second boom member is positioned on the first boom member. The assembly further includes a closure member that is attachable to the first boom member in a fixed position proximate the stop member and movable away from the fixed position. In addition, the assembly includes a planar wearpad that is insertable into the receptacle in the first direction when the closure member is moved away from the fixed position and the second boom member is positioned on the first boom member. The stop member and the closure member inhibit lateral movement of the wearpad in a direction parallel to the plane of the wearpad, and allow movement of the wearpad in a direction transverse to the plane of the wearpad, when the wearpad is positioned in the receptacle and the closure member is positioned in the fixed position. The second boom member inhibits movement of the wearpad in the direction transverse to the plane of the wearpad.

While exemplary embodiments are illustrated and disclosed, such disclosure should not be construed to limit the claims. It is anticipated that various modifications and alternative designs may be made without departing from the scope of the invention.

DETAILED DESCRIPTION

The present disclosure describes various configurations of a wearpad arrangement for use with a moveable member. Several specific embodiments are set forth in the following description and in FIGS. 1-7 to provide a thorough understanding of certain embodiments according to the present disclosure. As those of ordinary skill in the art will understand, one or more features of an embodiment illustrated and described with reference to any one of the Figures may be combined with features illustrated in one or more other Figures to produce embodiments that are not explicitly illustrated or described. In addition, other embodiments may be practiced without one or more of the specific features explained in the following description.

Figure 1:
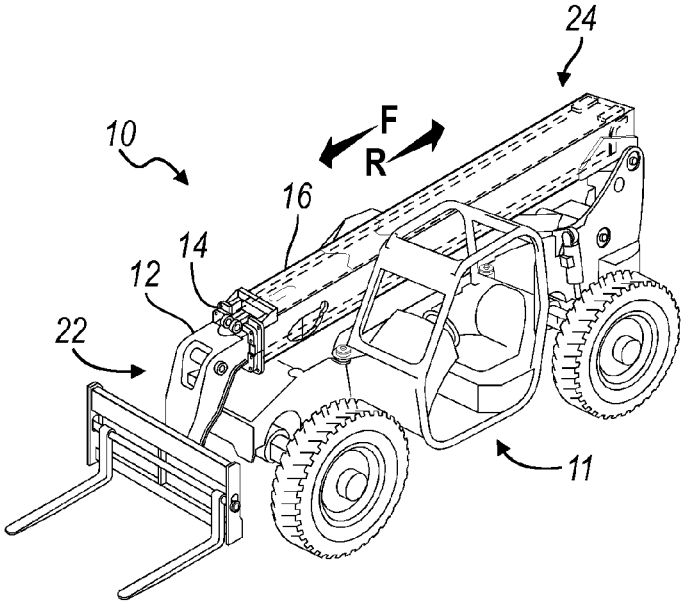
FIG. 1 is a perspective view of a boom assembly according to the present disclosure mounted on a vehicle, wherein the boom assembly includes multiple boom members that are shown in a retracted position.
Figure 2:
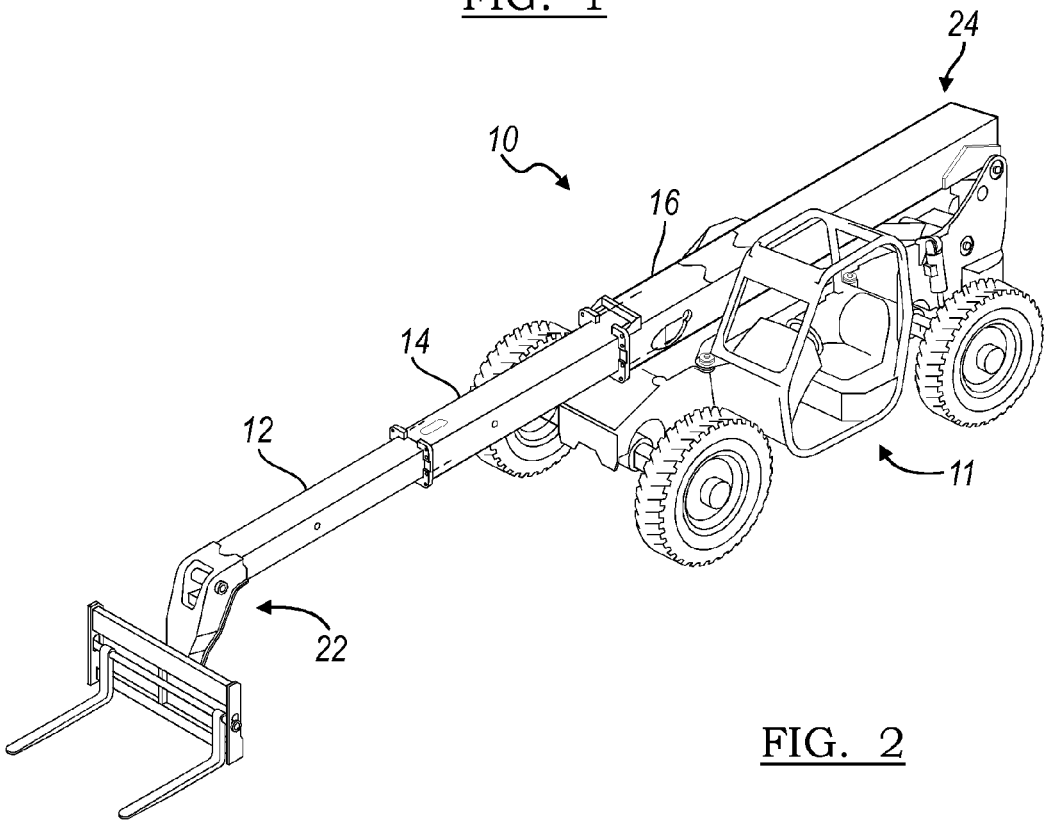
FIG. 2 is a perspective view of the boom assembly of FIG. 1 showing the boom members in an extended position.

FIG. 1 shows a boom assembly 10 according to the present disclosure attached to a vehicle 11. The boom assembly 10 includes a first boom member, such as an inner boom member 12, attached to a component, such as fork lift, work basket, or any other suitable component. The boom assembly 10 further includes a second boom member, such as an intermediate boom member 14, and a third boom member, such as an outer boom member 16. It should be noted that the terms first, second and third boom members may each be used to identify any of the above boom members.

The boom members 12, 14 and 16 may be made of any suitable material, such as metal, and may be made in any suitable manner. Furthermore, the boom members 12, 14 and 16 are slidable relative to each other such that the boom assembly 10 may be moved between a retracted position shown in FIG. 1 and an extended position shown in FIG. 2. In that regard, the inner boom member 12 may be telescopically received in the intermediate boom member 14, and the intermediate boom member 14 may be telescopically received in the outer boom member 16. Furthermore, the inner boom member 12 and the intermediate boom member 14 may each move in a first or forward direction F relative to the outer boom member 16 in order to move the boom assembly 10 to the extended position, and the inner and intermediate boom members 12 and 14, respectively, may each move in a second or rearward direction R in order to move the boom assembly 10 to the retracted position. To facilitate sliding movement of the boom members 12, 14 and 16, the boom assembly 10 is provided with a wearpad arrangement 18, as shown in FIGS. 3 and 4.

Figure 3:
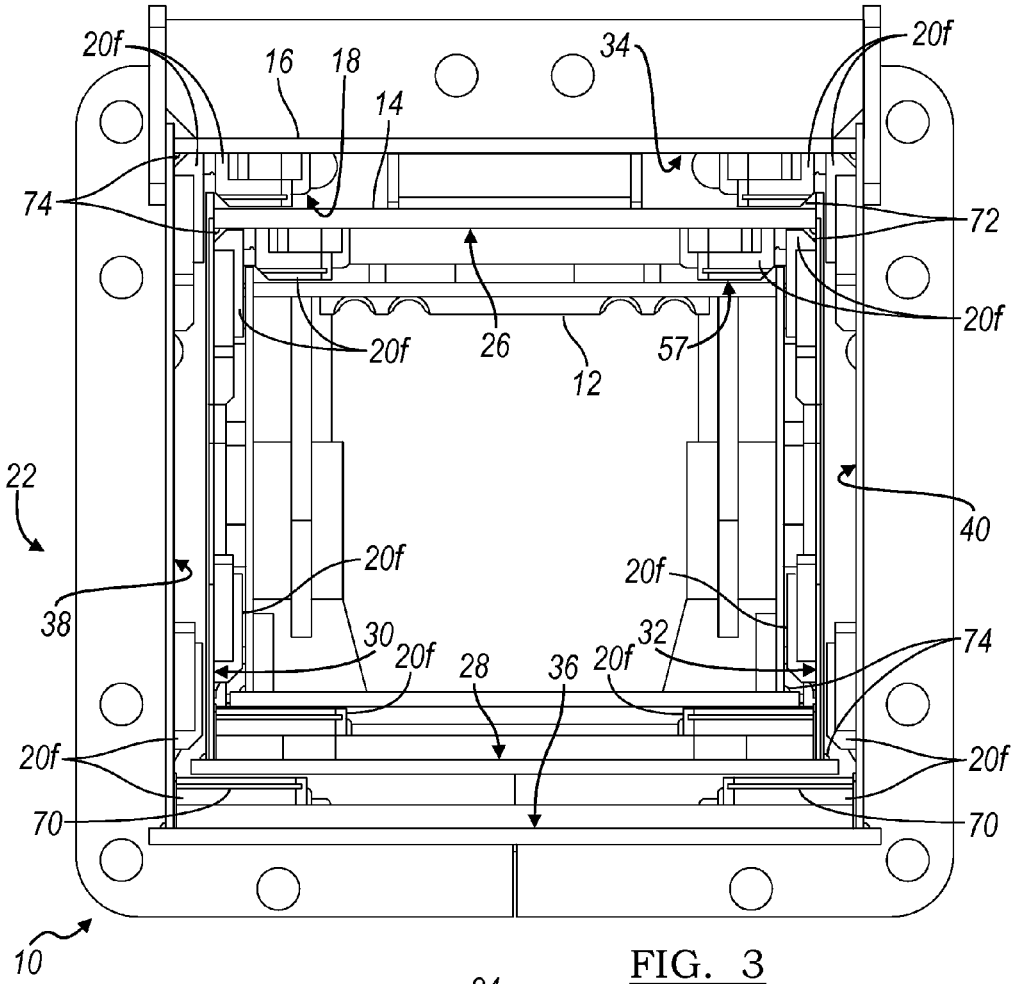
FIG. 3 is a cross-sectional view of the boom assembly taken at a front end of the boom assembly and viewed in a forward direction, wherein multiple wearpads are shown disposed between the boom members.
Figure 4:
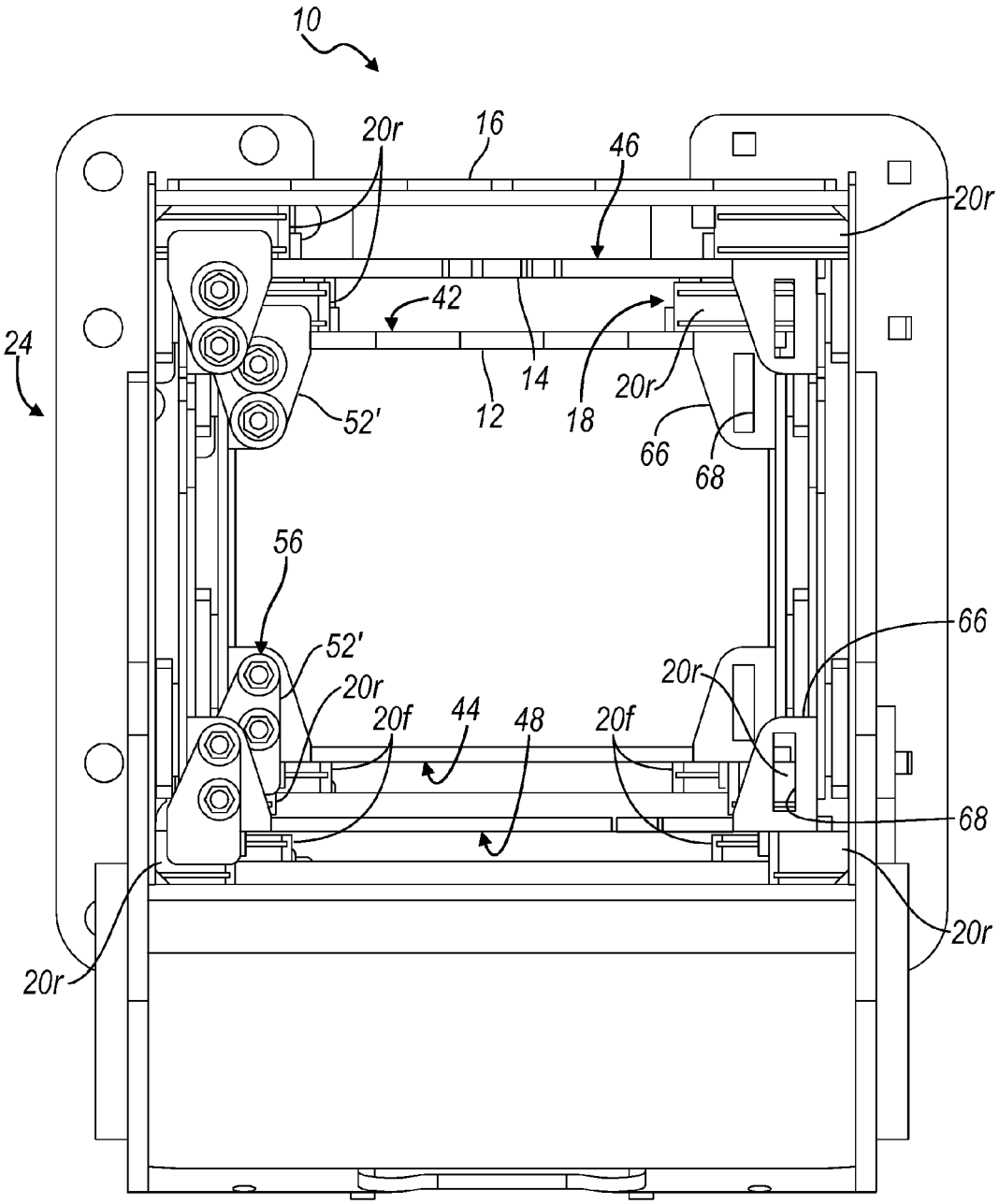
FIG. 4 is an end view of a rear end of the boom assembly including retainer members shown on the left side of the figure for retaining wearpads between the boom members, wherein retainer members have been removed from the right side of the figure to show additional features.
Figure 5:
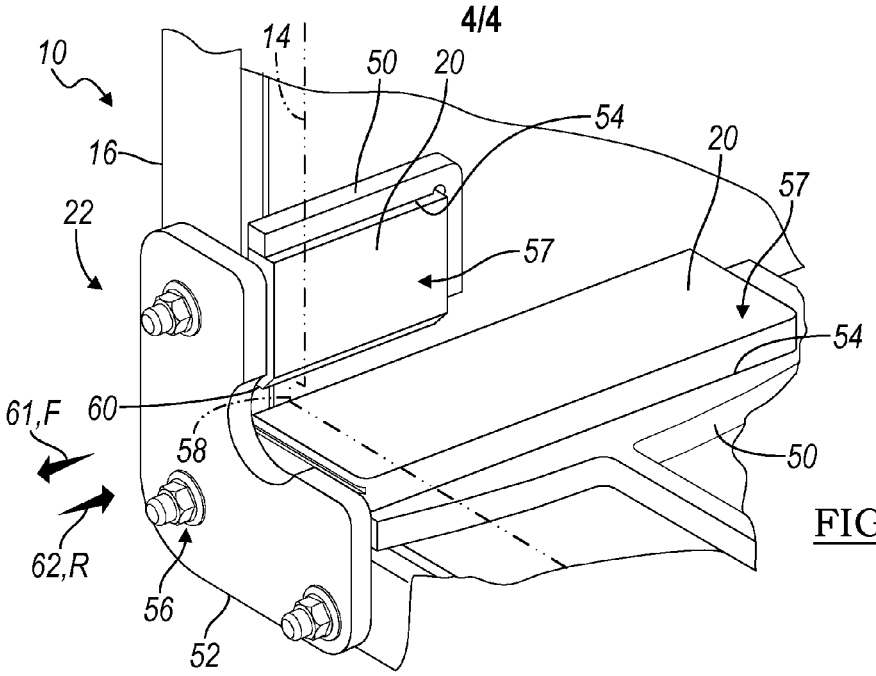
FIG. 5 is a perspective view of a portion of the front end of the boom assembly.

In the embodiment shown in FIGS. 3 and 4, the wearpad arrangement 18 includes sixteen generally planar wearpads 20 (labeled as 20*f* in FIGS. 3 and 4) disposed at a front end 22 of the boom assembly 10, and eight generally planar wearpads 20 (labeled as 20*r* in FIG. 4) disposed at a rear end 24 of the boom assembly 10. Alternatively, the wearpad arrangement 18 may include any suitable number of wearpads 20. Furthermore, the wearpads 20 may be made of any suitable material, such as ultra high molecular weight plastic (UHMW), nylon, polyurethane, and/or brass, that facilitates sliding movement of one boom member 12, 14, 16 with respect to another boom member 12, 14, 16.

Referring to FIG. 3, the sixteen wearpads 20 at the front end 22 of the boom assembly 10 include eight wearpads 20 mounted between the inner boom member 12 and the intermediate boom member 14, and eight wearpads 20 mounted between the intermediate boom member 14 and the outer boom member 16. More specifically, two wearpads 20 are mounted on each of an inner top surface 26, inner bottom surface 28, first inner side surface 30 and second inner side surface 32 of the intermediate boom member 14. In addition, two wearpads 20 are mounted on each of an inner top surface 34, inner bottom surface 36, first inner side surface 38 and second inner side surface 40 of the outer boom member 16.

Referring to FIG. 4, the eight wearpads 20 at the rear end 24 of the boom assembly 10 include four wearpads 20 mounted between the inner boom member 12 and the intermediate boom member 14, and four wearpads 20 mounted between the intermediate boom member 14 and the outer boom member 16. More specifically, two wearpads 20 are mounted on a top surface 42 of the inner boom member 12, two wearpads 20 are mounted on a bottom surface 44 of the inner boom member 12, two wearpads 20 are mounted on a top surface 46 of the intermediate boom member 14, and two wearpads 20 are mounted on a bottom surface 48 of the intermediate boom member 14.

The wearpads 20 may be mounted on one of the boom members 12, 14 and 16 without requiring any fasteners that extend through the wearpads 20. For example, referring to FIG. 5, which shows a portion of the front end 22 of the outer boom member 16, the wearpad arrangement 18 may include multiple stop members, such as frames 50, that are attached to the outer boom member 16 in any suitable manner, and a closure member or retainer member, such as an end plate 52, that cooperates with one or more of the frames 50 to define one or more retaining structures for one or more of the wearpads 20. In the embodiment shown in FIG. 5, each frame 50 is welded to the outer boom member 16 and at least partially defines a receptacle 54 for receiving one of the wearpads 20. Furthermore, the end plate 52 is removably attachable to the outer boom member 16, such as with one or more fasteners 56, and cooperates with the frames 50 to define two retaining structures for two wearpads 20 when the end plate 52 is attached to the outer boom member 16. Each retaining structure inhibits or prevents lateral movement of a respective wearpad 20 in directions parallel to the plane of the wearpad 20, while the intermediate boom member 14 (shown in phantom lines) inhibits or prevents movement of each wearpad 20 in a direction transverse to the plane of the respective wearpad 20.

The wearpads 20 may each be held or positioned loosely in a respective receptacle 54 defined by the frames 50 and the end plate 52. In that regard, the frames 50 and the end plate 52 may be configured to inhibit lateral movement of each wearpad 20 in a direction parallel to the plane of the wearpad 20, but allow movement of the wearpad in a direction transverse to the plane of the wearpad 20. As a result, if the intermediate boom member 14 were removed completely from the outer boom member 16, each wearpad 20 could be removed from the corresponding receptacle 54 in a direction transverse to the plane of the wear pad 20. When the intermediate boom member 14 is inserted into the outer boom member 16, however, the intermediate boom member 14 slidingly contacts planar surfaces 57 of the wearpads 20 and inhibits or prevents movement of each respective wearpad 20 in a direction transverse to the plane of the wearpad 20. In the embodiment shown in FIG. 5, a lower or bottom wall 58 of the intermediate boom member 14 also contacts a side surface 60 of the vertically oriented wearpad or side wearpad 20, and inhibits or prevents downward movement of that wearpad 20.

With the above configuration, the wearpads 20 may be easily removed and replaced if needed, due to wear of the wearpads 20 for example. Furthermore, the wearpads 20 may be removed and replaced with the intermediate boom member 14 still inserted into the outer boom member 16 and positioned immediately adjacent the frames 50. In that regard, the end plate 52 may be removed from the outer boom member 16 by removing or sufficiently loosening the fasteners 56. Each wearpad 20 may then be removed from the corresponding receptacle 54 by sliding the wearpad 20 in a direction 61 that is parallel to the movement direction F, R of the intermediate boom member 14 with respect to the outer boom member 16. New wearpads 20 may then be inserted into the receptacles 54 in an insertion direction 62 that is parallel to the direction 61. Next, the end plate 52 may be reattached to the outer boom member 16.

Figure 7:
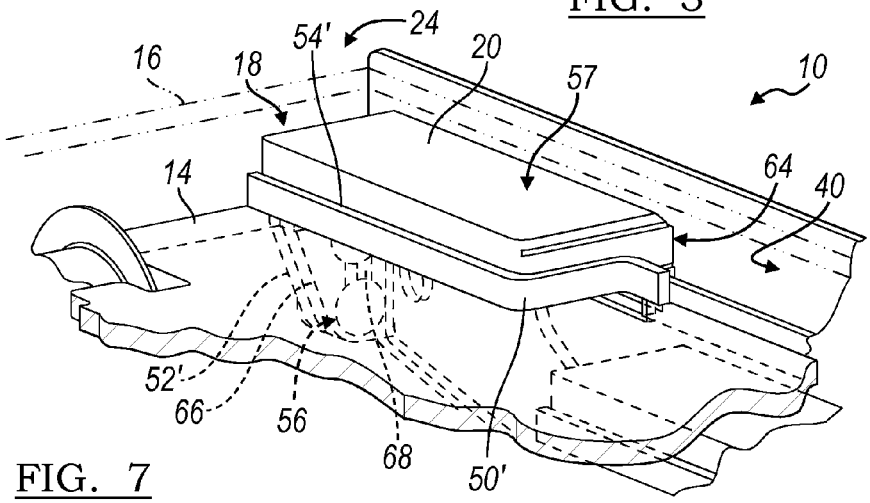
FIG. 7 is a rearwardly facing perspective view of a portion of the rear end of the boom assembly.
Figure 6:
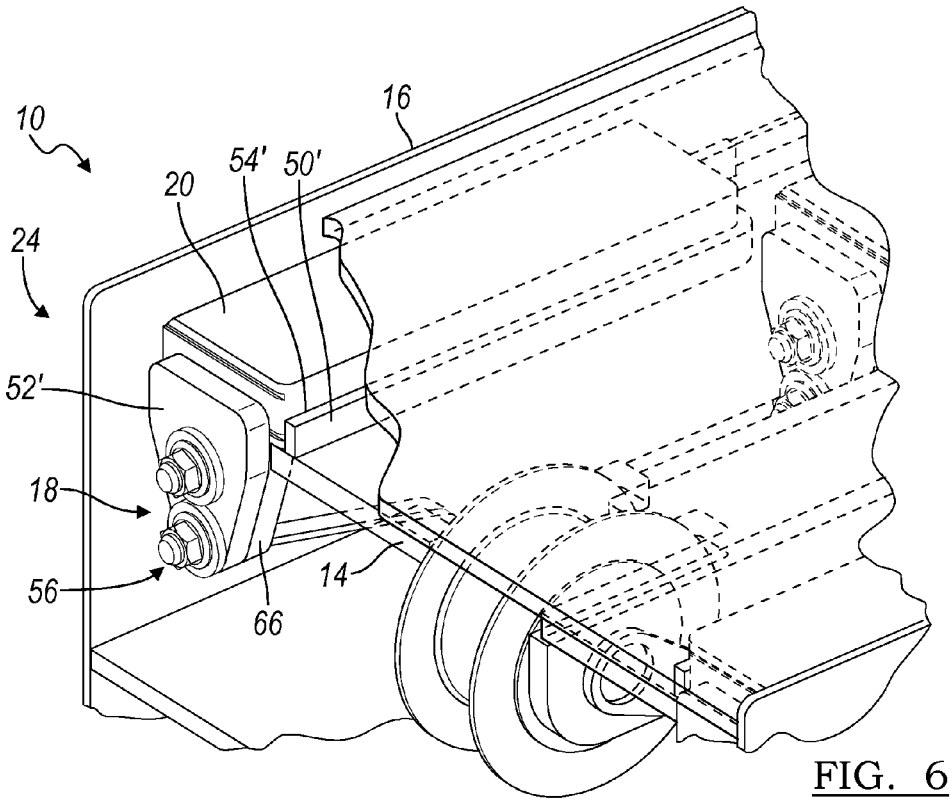
FIG. 6 is a perspective view of a portion of the rear end of the boom assembly.

Referring to FIGS. 6 and 7, which each show a portion of the rear end 24 of the boom assembly 10, another example mounting scheme for one of the wearpads 20 is shown. In this embodiment, the wearpad arrangement 18 includes a stop member such as frame 50' attached to the intermediate member 14, and a closure member or retainer member, such as an end plate 52', that is attachable to the intermediate member 14 in a fixed position, such that the end plate 52' cooperates with the frame 50' to inhibit lateral movement of the wearpad 20. As with the above embodiment, the wearpad 20 shown in FIGS. 6 and 7 may be held or positioned loosely in receptacle 54' defined by the frame 50' and the end plate 52', such that the wearpad 20 could be removed from the receptacle 54' in a direction transverse to the plane of the wearpad 20 if the intermediate boom member 14 were removed from the outer boom member 16. Furthermore, in this embodiment, the outer boom member 16 contacts top planar surface 57 of the wearpad 20 and inhibits or prevents movement of the wearpad 20 in a direction transverse to the plane of the wearpad 20.

In the embodiment shown in FIGS. 6 and 7, the wearpad 20 extends laterally beyond a side of the intermediate boom member 14, such that a side surface 64, which is perpendicular to the planar surface 57, of the wearpad 20 engages an inner side surface (e.g., the second inner side surface 40) of the outer boom member 16 (shown in phantom lines in FIG. 7). Thus, two surfaces 57 and 64 of the wearpad 20 shown in FIGS. 6 and 7 slidingly contact or engage two surfaces of the outer boom member 16. With such a configuration, only four wearpads 20 may be needed between the outer boom member 16 and the intermediate boom member 14 and between the intermediate boom member 14 and the inner boom member 12 at the rear end 24 of the boom assembly 10. Furthermore, the frame 50' may be configured to resist lateral loads applied on the wearpad 20 by the inner side surface of the outer boom member 16, such that the fasteners 56 are not loaded in a shear direction.

Referring to FIG. 7, the end plate 52' may be attached in the fixed position with one or more fasteners 56 to a bracket 66 that is fixedly attached to the intermediate boom member 14. Each fastener 56 may include a carriage bolt and corresponding nut, for example, and the bracket 66 may be provided with an elongated slot 68 that allows movement, such as vertical movement, of each bolt in a direction transverse to a longitudinal axis of the bolt when the nuts are sufficiently loosened. With such a configuration, when the fasteners 56 are sufficiently loosened, the end plate 52' may be moved sufficiently downwardly, or otherwise moved away from the fixed position and relative to the bracket 66, to allow the wearpad 20 to be removed from the receptacle 54' and replaced with another wearpad 20, without requiring removal of the end plate 52' from the bracket 66. As another example, the end plate 52' may be completely removed from the intermediate boom member 14 during removal and/or installation of the wearpad 20.

The end plate 52 at the front end 22 of the boom assembly 10, as well as the corresponding mounting structure on the outer boom member 16, may also be configured in a similar manner as described with respect to the end plate 52' and bracket 66. As a result, removal of the end plate 52 may not be required during removal and/or installation of the corresponding wearpads 20 at the front end 22 of the boom assembly.

With the above configuration, each wearpad 20 may be sufficiently held in place without requiring any fasteners that extend through the wearpad 20. As a result, usable surface area of each wearpad 20 may be maximized. Furthermore, the same size fasteners can be used at all locations of the boom assembly 10 to secure end plates or other closure members to a particular boom member 12, 14, 16. Still further, none of the fasteners 56 are loaded in a shear direction, even if the corresponding wearpad 20 experiences side loads. Instead, the fasteners 56 (e.g., bolts) may be loaded in tension. As a result, the fasteners 56 may last longer as compared to fasteners used in prior wearpad arrangements where the fasteners extend through corresponding wearpads.

In addition, because each frame 50 and 50' does not need to be configured to prevent movement of a corresponding wearpad 20 in a direction transverse to the plane of the wearpad 20, the frames 50 and 50' may be formed without transverse retaining features. As a result, the frames 50 and 50' do not need to be formed by expensive machining operations. Instead, the frames 50 and 50' may be formed by less expensive stamping or layer cut operations. Of course, the frames 50 and 50' may be formed of any suitable material and in any suitable manner.

Returning to FIGS. 3 and 4, each wearpad 20 may include a wear indicator that provides an indication of the amount of wear the wearpad 20 has experienced and/or that indicates when wearpad replacement may be desirable or required. For example, each wearpad 20 may be provided with a wear indicator groove 70 on a side of the wearpad 20. As another example, each wearpad 20 may be provided with an angled surface or chamfer 72 that extends between the planar surface 57 and a side surface of the wearpad 20, such that the chamfer 72 is spaced away from the boom member 12, 14, 16 on which the wearpad 20 is mounted. When a wearpad 20 wears down to a position at or below the groove 70 and/or chamfer 72, replacement of the wearpad may be required.

Alternatively or supplementally, the chamfer 72 on a particular wearpad 20 may provide clearance with respect to another component or feature on the boom assembly 10. For example, each chamfer 72 may provide clearance with respect to a weld bead 74 that joins walls of a particular boom member 12, 14, 16 together.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A wearpad arrangement for use with two members, wherein one of the members is slidable relative to the other member in a first direction, the wearpad arrangement comprising:

a frame that is attachable to one of the members such that the frame at least partially defines a receptacle;

a closure member that is attachable to the one member in a fixed position and movable away from the fixed position, wherein the closure member cooperates with the frame to define a retaining structure when the closure member is positioned in the fixed position; and a wearpad that is insertable into the receptacle in the first direction when the closure member is moved away from the fixed position and the other member is positioned on the one member, wherein when the wearpad is positioned in the receptacle and the closure member is positioned in the fixed position, the wearpad is held loosely in the receptacle by the retaining structure, and the wearpad is inhibited from moving out of the receptacle by contact with the other member, and wherein the wearpad has a chamfer configured to be spaced away from the one member when the wearpad is positioned in the receptacle, and the chamfer provides clearance with respect to a weld bead on the other member.

2. The wearpad arrangement of claim 1 wherein the wearpad includes a side surface having a wear indicator groove.

3. The wearpad arrangement of claim 1 wherein the wearpad is configured to extend laterally beyond a side of the one member when the wearpad is positioned in the receptacle, such that the wearpad engages a side surface of the other member.

4. The wearpad arrangement of claim 1 wherein the wearpad has a first surface and a second surface that extends at an angle with respect to the first surface, and wherein the first and second surfaces contact the other member when the wearpad is inserted into the receptacle.

5. The wearpad arrangement of claim 4 wherein the second surface is generally perpendicular to the first surface.

6. The wearpad arrangement of claim 1 wherein the closure member is attachable to the one member in the fixed position with one or more fasteners that extend in the first direction.

7. The wearpad arrangement of claim 1 further comprising an additional frame and an additional wearpad, wherein the additional frame is attachable to the one member such that the additional frame at least partially defines an additional receptacle proximate the receptacle, the closure member cooperates with the additional frame to define an additional retaining structure, and the additional wearpad is insertable into the additional receptacle in the first direction when the closure member is moved away from the fixed position and the other member is positioned on the one member such that the other member is positioned adjacent the frame and the additional frame.

8. The wearpad arrangement of claim 1 wherein the wearpad has a chamfer spaced away from the one member when the wearpad is positioned in the receptacle, and the chamfer is configured as a wear indicator.

9. A boom assembly comprising:

a first boom member;

a second boom member that is slidable relative to the first boom member in a first direction;

a stop member attached to the first boom member, the stop member at least partially defining a receptacle that faces the second boom member when the second boom member is positioned on the first boom member;

a closure member that is attachable to the first boom member in a fixed position proximate the stop member and movable away from the fixed position; and a planar wearpad that is insertable into the receptacle in the first direction when the closure member is moved away from the fixed position and the second boom member is positioned on the first boom member;

wherein the stop member and the closure member inhibit lateral movement of the wearpad in a direction parallel to the plane of the wearpad, and allow movement of the wearpad in a direction transverse to the plane of the wearpad, when the wearpad is positioned in the receptacle and the closure member is positioned in the fixed position, and the second boom member inhibits movement of the wearpad in the direction transverse to the plane of the wearpad, and wherein the closure member is attachable to the first boom member in the fixed position with one or more fasteners that extend in the first direction, and the first boom member has a slot that permits movement of the one or more fasteners in a direction transverse to the first direction.

10. The boom assembly of claim 9 wherein the stop member is configured as a frame that extends along at least two sides of the wearpad when the wearpad is positioned in the receptacle.

11. The boom assembly of claim 9 wherein the wearpad extends laterally beyond a side of the first boom member when the wearpad is positioned in the receptacle, such that the wearpad engages a side surface of the second boom member.

12. The boom assembly of claim 9 wherein the wearpad has a first surface and a second surface that extends at an angle with respect to the first surface, and wherein the first and second surfaces contact the second boom member when the wearpad is inserted into the receptacle.

13. The boom assembly of claim 9 further comprising an additional stop member and an additional wearpad, wherein the additional stop member is attached to the first boom member such that the additional stop member at least partially defines an additional receptacle proximate the receptacle, the closure member cooperates with the additional stop member to define an additional retaining structure, and the additional wearpad is insertable into the additional receptacle in the first direction when the closure member is moved away from the fixed position and the second boom member is positioned on the first boom member such that the second boom member is positioned adjacent the stop member and the additional stop member.

14. The boom assembly of claim 9 wherein the wearpad has a chamfer spaced away from the first boom member when the wearpad is positioned in the receptacle, and the chamfer is configured as a wear indicator and provides clearance with respect to a feature on the second boom member.

15. The boom assembly of claim 9 wherein the wearpad does not include any openings for receiving fasteners.

16. A boom assembly comprising:

a first boom member;

a second boom member that is slidable relative to the first boom member in a first direction;

a frame attached to the first boom member, the frame at least partially defining a receptacle;

a closure member that is attachable to the first boom member in a fixed position proximate the frame and movable away from the fixed position, wherein the closure member cooperates with the frame to define a retaining structure when the closure member is positioned in the fixed position; and a planar wearpad that is insertable into the receptacle in the first direction when the closure member is moved away from the fixed position and the second boom member is positioned on the first boom member, such that the wearpad is positionable between the first boom member and the second boom member, wherein the wearpad has a first surface and a second surface that extends at an angle with respect to the first surface, and wherein the first and second surfaces contact the second boom member when the wearpad is inserted into the receptacle;

wherein the frame and the closure member inhibit lateral movement of the wearpad in directions parallel to the plane of the wearpad, and allow movement of the wearpad in a direction transverse to the plane of the wearpad, when the wearpad is positioned in the receptacle and the closure member is positioned in the fixed position, and wherein the second boom member inhibits movement of the wearpad in the direction transverse to the plane of the wearpad;

and wherein the closure member is attachable to the first boom member in the fixed position with one or more fasteners that extend in the first direction, and the first boom member has a slot that permits movement of the one or more fasteners in a direction transverse to the first direction.

17. The boom assembly of claim 16 wherein the second surface is generally perpendicular to the first surface.

* * * * *